US007425160B2

(12) United States Patent
Lee

(10) Patent No.: US 7,425,160 B2
(45) Date of Patent: Sep. 16, 2008

(54) STACKABLE CONNECTOR

(75) Inventor: Yu Tsan Lee, Luijha Township, Taoyuan County (TW)

(73) Assignee: Super Link Electronics Co., Ltd., Taoyuan County (TW)

( * ) Notice: Subject to any disclaimer, the term of this patent is extended or adjusted under 35 U.S.C. 154(b) by 0 days.

(21) Appl. No.: 11/787,987

(22) Filed: Apr. 17, 2007

(65) Prior Publication Data

US 2008/0200063 A1 Aug. 21, 2008

(30) Foreign Application Priority Data

Feb. 16, 2007 (TW) ..... 96106160 A

(51) Int. Cl.
*H01R 13/24* (2006.01)

(52) U.S. Cl. ..... 439/701

(58) Field of Classification Search ..... 439/733.1, 439/701, 326, 516

See application file for complete search history.

(56) References Cited

U.S. PATENT DOCUMENTS 5,525,071 A * 6/1996 Obara et al. ..... 439/326
5,567,171 A * 10/1996 Mizuguchi ..... 439/326
6,386,925 B1 * 5/2002 Sato et al. ..... 439/701

* cited by examiner

*Primary Examiner*—Tho D Ta
(74) *Attorney, Agent, or Firm*—Abelman, Frayne & Schwab

(57) ABSTRACT

A stackable connector is disclosed herein. The stackable connector includes an insulation housing having a plurality of trenches penetrating through the insulation housing, a protrusion portion, a concave portion opposite to the protrusion portion, and a plurality of terminals arranged in those trenches. The design, which the concave portion is engaged with the protrusion portion and the structure of the contact portions of those terminals are elastic, can achieve the stackable, space-saving, reliability-increasing and cost-down purposes.

17 Claims, 5 Drawing Sheets

STACKABLE CONNECTOR

BACKGROUND OF THE INVENTION

1. Field of the Invention

The present invention relates to a connector, and more particularly, to a package of the connector which may stack repeatedly.

2. Description of the Prior Art

Along with the rapid progress of the computer and internet communication, the semiconductor products needs to be multi-functional, portable, light, thin, and small-sized to satisfy the customers' demand. Therefore, the industry of chip package has to develop towards the high accurate processes to comply with the requirements of high-power, high-density, lightness, thinness, compactness and mini-size. In addition, the electronics packaging also needs to have the features including high reliability and good thermal dissipation to transmit signals and provide electrical power, and provide effective routes for thermal dissipation, structural protection and support.

Presently, the three-dimensional (3-D) package may be distinguished into two categories, the Package on Package (PoP) and the Package in Package (PiP). The PoP is a typical 3-D package, which utilizes the process technology to stack two independent completed packages. In the other way, PiP utilizes a spacer to stack a single package without mounting solder balls onto a chip and then package them together using the Epoxy Molding Compound (EMC). Because the PoP utilizes the method of the Surface Mount Technology (SMT) to stack two independent packages which have been packaged and tested, it may reduce the process risk and so as to promote the product yield.

A manufacturing method for a conventional PoP is that it sets a Printed Circuit Board (PCB) spacer between the electrical connections of the carrier plates for two packages and utilizes the SMT method to fuse the two packages. Owing to the electrical terminals on the PCB spacer have to be set one on one corresponding to the terminals on the carrier plate of the package, the inaccurate alignment and the bad connection between the materials are two possible problems. Additionally, a warpage phenomenon may be induced by the different Thermal Expansion Coefficients (TECs) of the different materials, and the bad connection may further lead to a popcorn phenomenon.

SUMMARY OF THE INVENTION

In order to solve the aforementioned problems, one object of the present invention is to provide a stackable connector to replace the conventional soldering way adopting the solder balls, and so as to resolve the alignment problem of the surface mount technology.

One object of the present invention is to provide a stackable connector, utilizing the protrusion portion along with the concave portion of the connector to stack plural connectors may effectively reduce the stack height.

One object of the present invention is to provide a stackable connector, the terminals having the elastic structure may elastically and electrically contact with an external apparatus, such as a package. The design of the upper contact portion and the lower contact portion may fix and contact the connector with an external apparatus stably and tightly.

One object of the present invention is to provide a stackable connector, the terminals having the elastic structure may elastically and electrically contact with an external apparatus, such as a package. The tolerance can be easily adjusted because of the elastic design of the terminals, and so as to promote the reliability of the electrical connection.

One object of the present invention is to provide a stackable connector, the production cost can be reduced because of its simple manufacturing process.

To achieve the above-mentioned objects, one embodiment of the present invention is to provide a stackable connector, which includes: an insulation housing having a plurality of trenches and a protrusion portion, wherein the trenches are abreast arranged on one side of the insulation housing and the protrusion portion is protruded to the side of the insulation housing; a concave portion set oppositely to the protrusion portion on the other side of the insulation housing; and a plurality of terminals arranged in the trenches, wherein each of the terminals has a contact portion, an engagement portion and two electrical connection portions; each of the terminals is fixed in the insulation housing with the engagement portion; and one of the electrical connection portions is extended to the protrusion portion and partially exposed to the insulation housing.

To achieve the above-mentioned objects, another embodiment of the present invention is to provide a stackable connector, which includes: a first connector including: a first insulation housing having a plurality of trenches and a protrusion portion, wherein the trenches are abreast arranged on one side of the first insulation housing and the protrusion portion is protruded to the side of the first insulation housing; a concave portion set oppositely to the protrusion portion on the other side of the first insulation housing; and a plurality of first terminals arranged in the trenches, wherein each of the first terminals has a contact portion, an engagement portion and two electrical connection portions; each of the first terminals is fixed in the first insulation housing with the engagement portion; and one of the electrical connection portions is extended to the protrusion portion and partially exposed to the first insulation housing; and a second connector having: a second insulation housing; a plurality of second terminals abreast arranged in the second insulation housing and partially exposed; and an accommodating trench set in one side of the second insulation housing, wherein the protrusion portion of the first connector is correspondingly inserted into the accommodating trench of the second connector, and the first terminals and the second terminals are electrically connected to stack the first connector and the second connector.

Other objects, technical contents, features and advantages of the present invention will become apparent from the following description taken in conjunction with the accompanying drawings wherein are set forth, by way of illustration and example, certain embodiments of the present invention.

BRIEF DESCRIPTION OF THE DRAWINGS

The foregoing aspects and many of the accompanying advantages of this invention will become more readily appreciated as the same becomes better understood by reference to the following detailed description, when taken in conjunction with the accompanying drawings, wherein.

DESCRIPTION OF THE PREFERRED EMBODIMENT

The detailed explanation of the present invention is described as following. The described preferred embodiments are presented for purposes of illustrations and description, and they are not intended to limit the scope of the present invention.

Figure 1A:
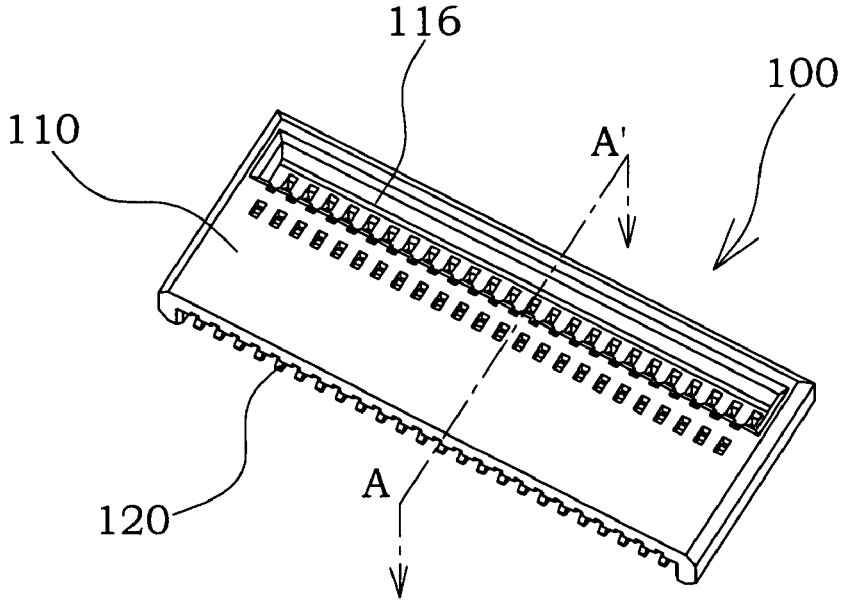
FIG. 1A is a solid schematic diagram of a stackable connector according to one embodiment of the present invention.
Figure 1B:
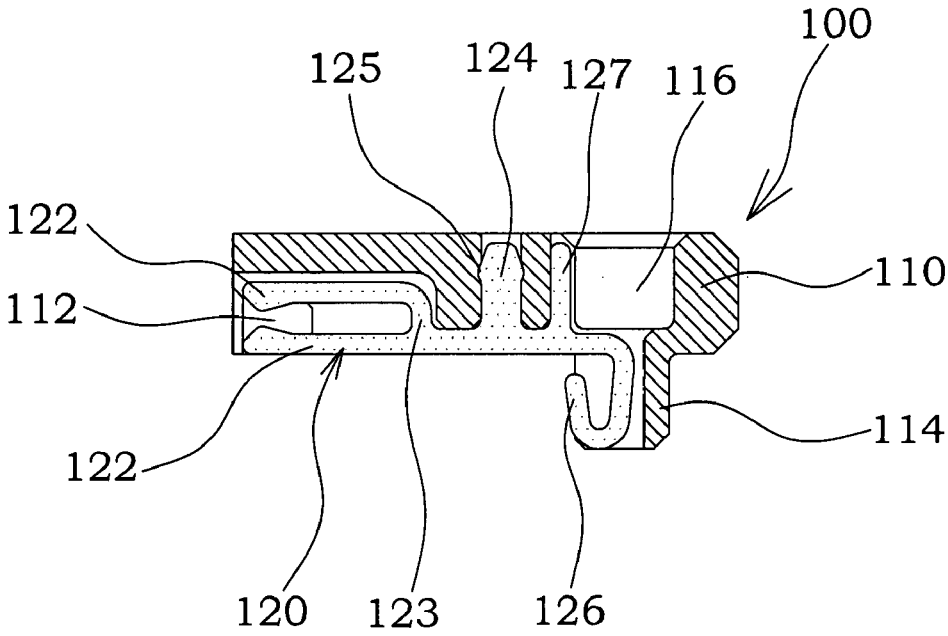
FIG. 1B is a cross-sectional schematic diagram taken from the cross-segment AA' in FIG. 1A.

Firstly, please refer to FIG. 1A and FIG. 1B, FIG. 1A and FIG. 1B are a solid schematic diagram and a cross-sectional schematic diagram taken from the cross-segment AA' respectively according to one embodiment of the present invention. As shown in the figures, a stackable connector 100 includes: an insulation housing 110; a concave portion 116; and a plurality of terminals 120. As shown in FIG. 1B, the insulation housing 110 has a plurality of trenches 112 and a protrusion portion 114, wherein the trenches 112 are abreast arranged on one side of the insulation housing 110 and the protrusion portion 114 is protruded to this side of the insulation housing 110. A concave portion 116 is set oppositely to the protrusion portion 114 on the other side of the insulation housing 110. It means, in this embodiment, the protrusion portion 114 and the concave portion 116 are correspondingly positioned on two opposite sides of the insulation housing 110. A plurality of terminals 120 are arranged in the trenches 112, wherein each of the terminals 120 has a contact portion 122, an engagement portion 124 and two electrical connection portions 126, 127. Anyone of the terminals 120 is fixed in the insulation housing 110 with the engagement portion 124; and one of the electrical connection portions, such as the electrical connection portion 126 is extended to the protrusion portion 114 and partially exposed to the insulation housing 110.

Continuing the above description, in one embodiment, the shape of the concave portion 116 is accommodated to the shape of the protrusion portion 114 to facilitate stacking a successive connector. In addition, the connector 100 further includes a protrusion portion 125 protruded to the engagement portion 124 of each of the terminals 120 to facilitate the terminals 120 being engaged in the trenches 112 with the protrusion portion 125. Further, in order to facilitate the terminals 120 having a good electrical contact with an external apparatus such as a package and accommodating the plugging stress of the external apparatus, the contact portion 122 of the terminals 120 is designed as an elastic structure to elastically contact with an external apparatus.

As shown in FIG. 1B, in this embodiment, the contact portion 122 of the terminals 120 is defined as an upper contact portion and a lower contact portion, wherein the upper contact portion and the lower contact portion are arranged in opposite positions and connected by an elastic portion 123. When an external apparatus is inserted, the upper contact portion and the lower contact portion of the terminals 120 will clip from the upper and lower sides to fix the external apparatus in the connector 100 and electrically connect with each other. The elastic structure of the contact portion 122 may provide not only a stable fixing function to clip from the upper and lower sides but also an tolerance to endure the deformation because of the thermal warpage or expansion. It can be appreciated that the structure of the terminals 120 is not limited by which depicted in FIG. 1B. Only if satisfy the terminals 120 a requirement that the contact portion 122 has a clipping function, they are all enclosed in the scope of the present invention. Additionally, the structure of the electrical connection portions 126, 127 are not limited by which depicted in FIG. 1B, either. Only if satisfy they a requirement that one end partially exposes to the insulation housing 110 and the other end may electrically connect with another connector, they are all enclosed in the scope of the present invention.

Figure 1C:
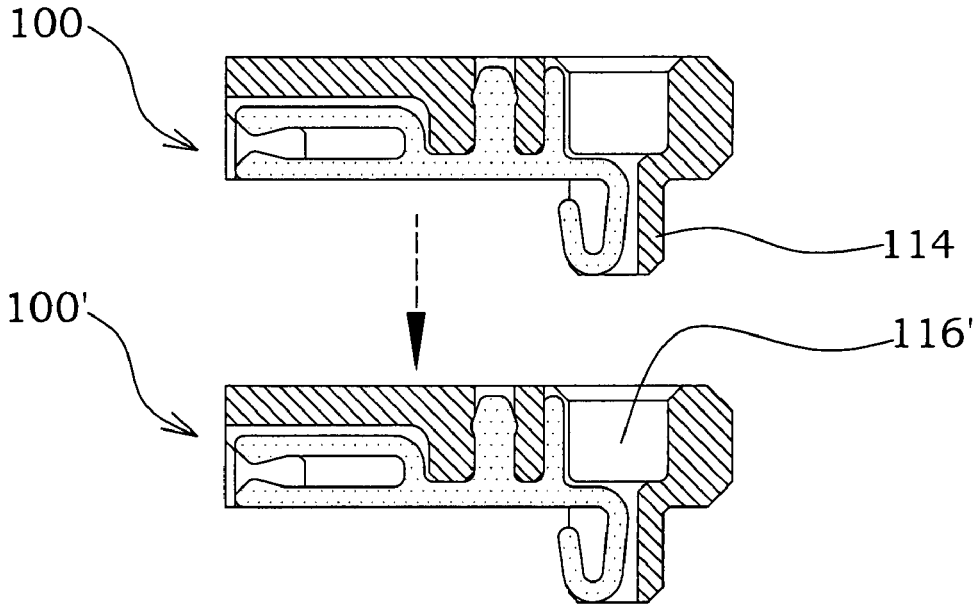
FIG. 1C and FIG. 1D are the cross-sectional schematic diagrams for the structures during and after the stack process according to one embodiment of the present invention.
Figure 1D:
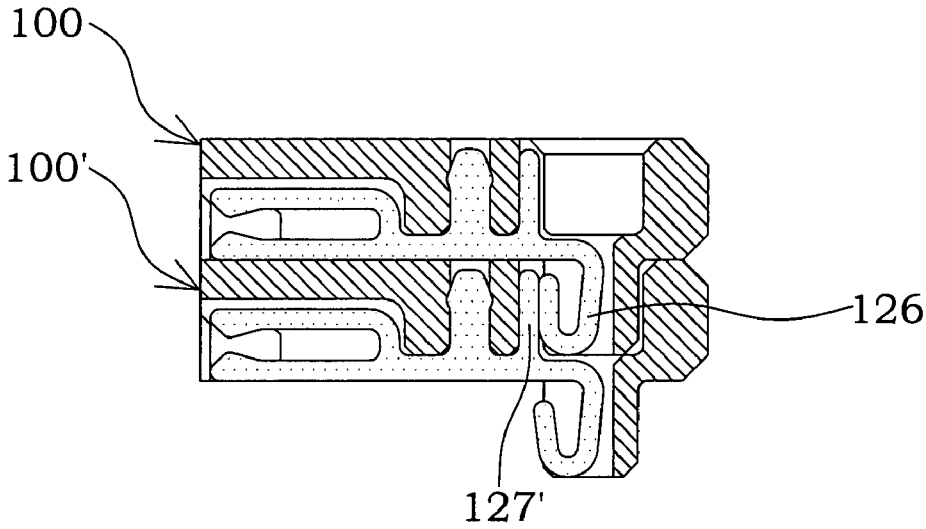

Continuing the above description, please refer to FIG. 1C and FIG. 1D, FIG. 1C and FIG. 1D are the cross-sectional schematic diagrams for the structures during and after the stack process according to one embodiment of the present invention. Firstly, please refer to FIG. 1C, the connectors 100 and 100' are stacked vertically according to the arrow direction. As shown in the figure, the protrusion portion 114 of the connector 100 is correspondingly inserted into the concave portion 116' of the connector 100' to stack the plural connectors 100 and 100'. In this embodiment, the connectors 100 and 100' have the same structures, and the stack structure after the stack process is depicted in FIG. 1D. The partially exposed electrical connection portion 126 of the connector 100 is electrically connected with the electrical connection portion 127' of the connector 100'. The quantity of the stack connectors is not limited by which depicted in FIG. 1D. The connectors may be repeatedly stacked via the protrusion portion and its matching concave portion.

Figure 2A:
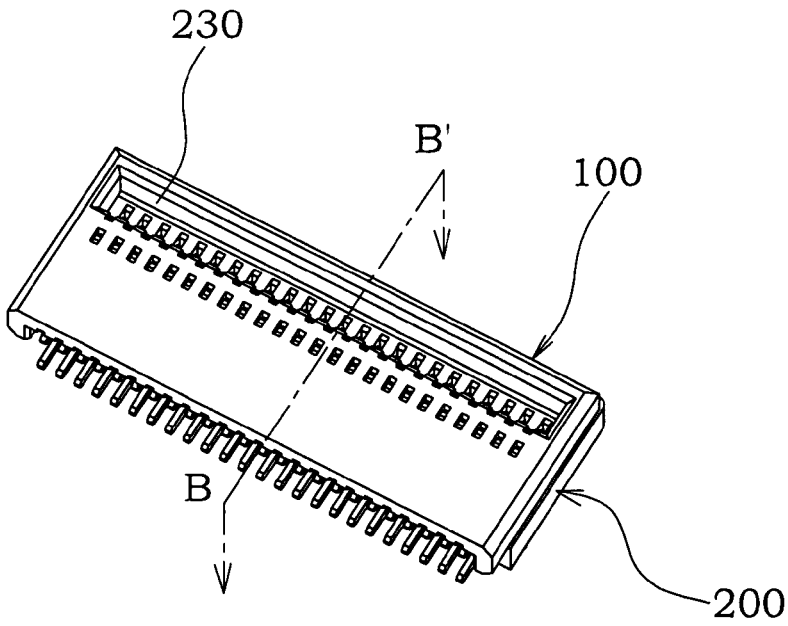
FIG. 2A is a solid schematic diagram of a stackable connector according to another embodiment of the present invention.
Figure 2B:
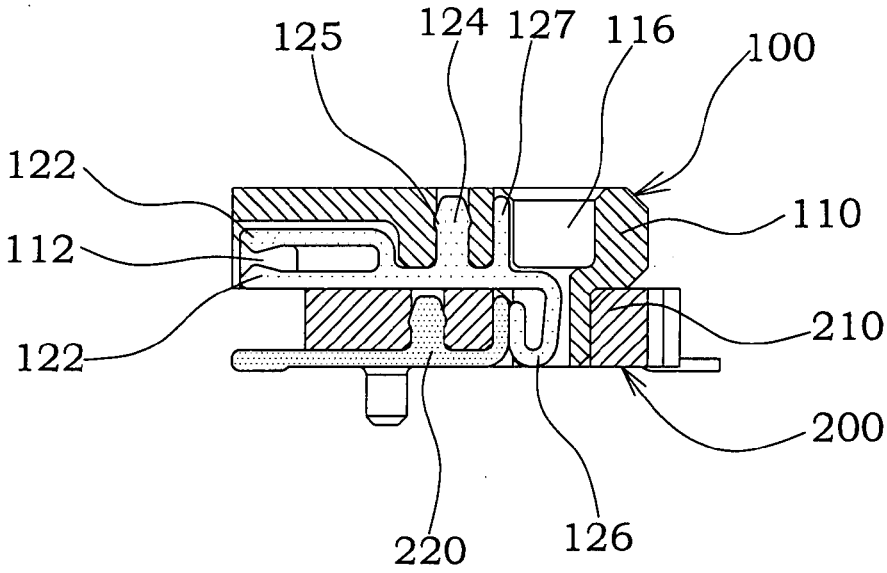
FIG. 2B is a cross-sectional schematic diagram taken from the cross-segment BB' in FIG. 2A.

Next, please refer to FIG. 2A and FIG. 2B, FIG. 2A and FIG. 2B are a solid schematic diagram and a cross-sectional schematic diagram taken from the cross-segment BB' respectively according to another embodiment of the present invention. As shown in FIG. 2B, the stack connectors include a first connector 100 and a second connector 200. The first connector 100 includes: a first insulation housing 110 having a plurality of trenches 112 and a protrusion portion 114, wherein the trenches 112 are abreast arranged on one side of the first insulation housing 110 and the protrusion portion 114 is protruded to this side of the first insulation housing 110; a concave portion 116 set oppositely to the protrusion portion 114 on the other side of the first insulation housing 110, it means, similar to the previous embodiment, the protrusion portion 114 and the concave portion 116 are correspondingly positioned on two opposite sides of the insulation housing 110; and a plurality of first terminals 120 arranged in the trenches 112. Wherein each of the first terminals 120 has a contact portion 122, an engagement portion 124 and two electrical connection portions 126, 127; each of the first terminals 120 is fixed in the first insulation housing 110 with the engagement portion 124; and one of the electrical connection portions, such as the electrical connection portion 126 is extended to the protrusion portion 114 and partially exposed to the first insulation housing 110.

Continuing the above description, please continuously refer to FIG. 2B along with FIG. 2A, the second connector 200 has: a second insulation housing 210; a plurality of second terminals 220 abreast arranged in the second insulation housing 210 and partially exposed; and an accommodating trench 230 set in one side of the second insulation housing 210. Wherein the protrusion portion 114 of the first connector 100 is correspondingly inserted into the accommodating trench 230 of the second connector 200 and the first terminals 120 and the second terminals 220 are electrically connected to stack the first connector 100 and the second connector 200.

In one embodiment, the shape of the protrusion portion 114 is accommodated to the shape of the accommodating trench 230 to facilitate stacking the first connector 100 and the second connector 200 successively. Further, the shape of the concave portion 116 of the first connector 100 may also accommodate to the shape of the protrusion portion 114 to facilitate a connector with the same structure stacking successively. Additionally, the first connector 100 further includes a protrusion portion 125 protruded to the engagement portion 124 of each of the terminals 120 to facilitate the terminals 120 being engaged in the trenches 112 with the protrusion portion 125. Further, in order to facilitate the terminals 120 having a good electrical contact with an external apparatus such as a package and accommodating the plugging stress of the external apparatus, the contact portion 122 of the terminals 120 is designed as an elastic structure to elastically contact with an external apparatus. The elastic structure of the terminals 120 is the same as the previous embodiment, so it is not further described herein.

Figure 2C:
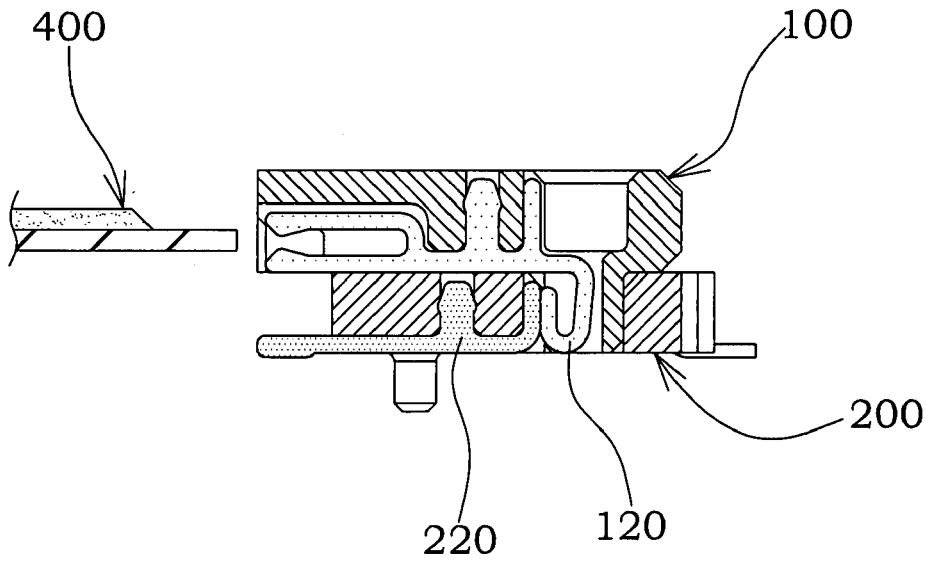
FIG. 2C is a solid schematic diagram of a stackable connector according to another embodiment of the present invention.
Figure 2D:
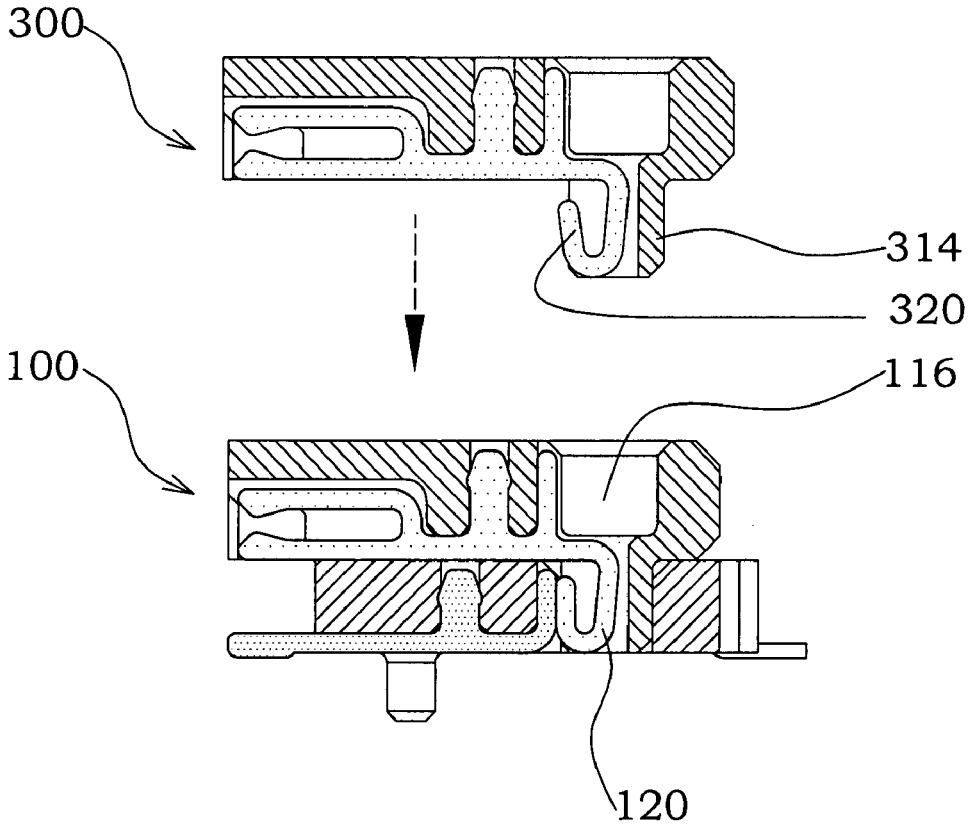
FIG. 2D and FIG. 2E are the cross-sectional schematic diagrams for the structures during and after the stack process according to another embodiment of the present invention.
Figure 2E:
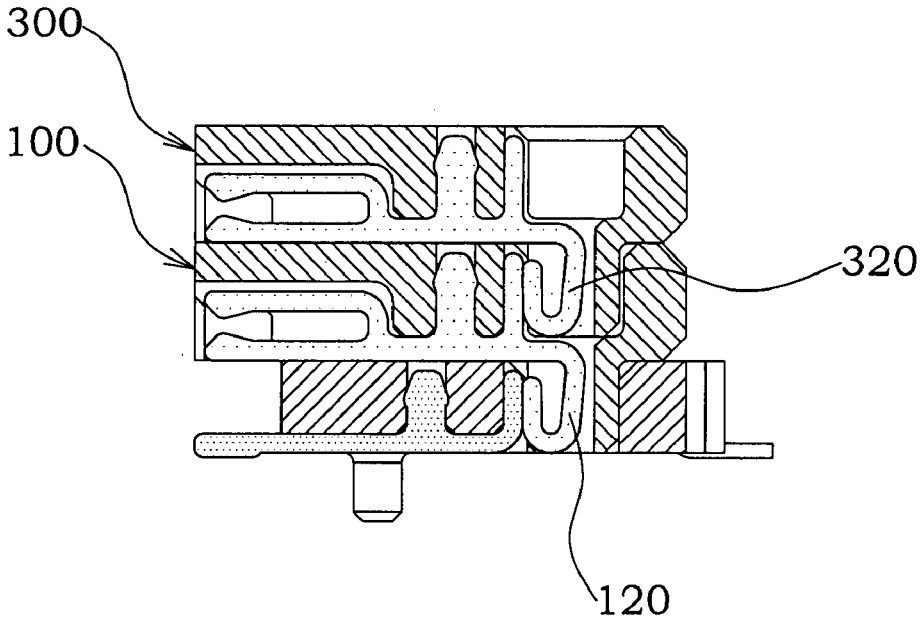

Continuing the above description, in another embodiment, a solder pad may be further set on the second connector 200 to fix the stack structure to an apparatus, such as a mother board, to provide the electrical connection. As shown in FIG. 2C, an external apparatus, such as a package 400 may electrically connect to a mother board via the terminals 120 of the first connector 100 and the second terminals 220 of the second connector 200. In another embodiment, as shown in FIG. 2D and FIG. 2E, the stack structure further includes a third connector 300 arranged on the first connector 100. As shown in FIG. 2D, the third connector 300 has a protrusion portion 314 correspondingly inserted into the trench 116 of the first connector 100 to form a stack structure. Additionally, the third connector 300 has a plurality of third terminals 320 partially exposed to the protrusion portion 314 and electrically connected to the first terminal 120 of the first connector 100. The stack structure after the stack process is shown in FIG. 2E. In this embodiment, the structure of the third connector 300 is the same as the structure of the first connector 100, but it is not limited to this. Only if has the third connector a corresponding protrusion portion to insert into the first connector 100 to electrically connect, it will be complied with the spirit of the present invention. And, the quantity of the stack connectors is not limited by which depicted in FIG. 2E. The connectors may be repeatedly stacked according to different demands.

According to the aforementioned description, one feature of the present invention is to implement a male plug and a female socket in one body to connect and engage with each other, and so as to stack plural connectors. The stackable connectors of the present invention may be applied to stack the semiconductor packages, but it may be appreciated which is not limited to this. And, the design of the upper and lower contact portions of the terminals can not only stably fix an external apparatus to provide the balanced upper and lower supporting forces, but also facilitate easy plugging by the elastic design for the elastic portion to avoid the damage of the terminals from the improper enforcing.

To summarize, the present invention provides a stackable connector. The stack connectors are used to replace the conventional soldering way adopting the solder balls, and so as to resolve the alignment problem of the surface mount technology. And, the design of the protrusion portion along with the trench of the connector to stack plural connectors may effectively reduce the stack height. In addition, the terminals having the elastic structure may elastically and electrically contact with an external apparatus, such as a package. The design of the upper contact portion and the lower contact portion may fix and contact the connector with an external apparatus stably and tightly. Besides, the tolerance can be easily adjusted because of the elastic design of the terminals, and so as to promote the reliability of the electrical connection. Furthermore, the production cost can be reduced for the present invention because of its simple manufacturing process.

The foregoing descriptions of specific embodiments of the present invention have been presented for purposes of illustrations and description. They are not intended to be exclusive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to particular use contemplated. It is intended that the scope of the invention be defined by the claims appended hereto and their equivalents.

What is claimed is:

1. A stackable connector, comprising: an insulation housing having a plurality of trenches and a protrusion portion, wherein said trenches are abreast arranged on one side of said insulation housing and said protrusion portion is protruded to said side of said insulation housing; a concave portion set oppositely to said protrusion portion on the other side of said insulation housing; and a plurality of terminals arranged in said trenches, wherein each of said terminals has a contact portion, an engagement portion and two electrical connection portions; each of said terminals is fixed in said insulation housing with said engagement portion; and one of said electrical connection portions is extended to said protrusion portion and partially exposed to said insulation housing.

2. The stackable connector according to claim 1, wherein the shape of said concave portion corresponds to the shape of said protrusion portion.

3. The stackable connector according to claim 1, further comprising at least one protrusion portion protruded to said engagement portion of each of said terminals.

4. The stackable connector according to claim 3, wherein said terminals are engaged in said trenches with said protrusion portion of said engagement portion.

5. The stackable connector according to claim 1, wherein said contact portions of said terminals are defined as an upper contact portion and a lower contact portion, wherein said upper contact portion and said lower contact portion are arranged in opposite positions and connected by an elastic portion.

6. The stackable connector according to claim 1, wherein said contact portions of said terminals are to elastically contact with an external apparatus.

7. The stackable connector according to claim 1, wherein said protrusion portion of said stackable connector is to insert into a corresponding concave portion of the other stackable connector to stack these two stackable connectors.

8. A stackable connector, comprising: a first connector comprising: a first insulation housing having a plurality of trenches and a protrusion portion, wherein said trenches are abreast arranged on one side of said first insulation housing and said protrusion portion is protruded to said side of said first insulation housing; a concave portion set oppositely to said protrusion portion on the other side of said first insulation housing; and a plurality of first terminals arranged in said trenches, wherein each of said first terminals has a contact portion, an engagement portion and two electrical connection portions; each of said first terminals is fixed in said first insulation housing with said engagement portion; and one of said electrical connection portions is extended to said protrusion portion and partially exposed to said first insulation housing; and a second connector having: a second insulation housing; a plurality of second terminals abreast arranged in said second insulation housing and partially exposed; and an accommodating trench set in one side of said second insulation housing, wherein said protrusion portion of said first connector is correspondingly inserted into said accommodating trench of said second connector, and said first terminals and said second terminals are electrically connected to stack said first connector and said second connector.

9. The stackable connector according to claim 8, wherein the shape of said concave portion corresponds to the shape of said protrusion portion.

10. The stackable connector according to claim 8, further comprising at least one protrusion portion protruded to said engagement portion of each of said terminals.

11. The stackable connector according to claim 10, wherein said first terminals are engaged in said trenches with said protrusion portion of said engagement portion.

12. The stackable connector according to claim 8, wherein said contact portions of said terminals are defined as an upper contact portion and a lower contact portion, wherein said upper contact portion and said lower contact portion are arranged in opposite positions and connected by an elastic portion.

13. The stackable connector according to claim 8, wherein said contact portions of said terminals are to elastically contact with an external apparatus.

14. The stackable connector according to claim 8, further comprising at least one solder pad set on said second connector.

15. The stackable connector according to claim 14, wherein said second connector is set on and electrically connected to a mother board by said utilizing said solder pad.

16. The stackable connector according to claim 8, further comprising a third connector arranged on said first connector, wherein said third connector has a protrusion portion correspondingly inserted into said concave portion of said first connector to form a stack structure.

17. The stackable connector according to claim 16, wherein said third connector has a plurality of third terminals partially exposed to said protrusion portion and electrically connected to said first terminal of said first connector.

* * * * *